US005419152A

United States Patent [19]

Silber

[11] Patent Number: 5,419,152

[45] Date of Patent: May 30, 1995

[54] APPARATUS FOR PACKAGING TEMPERATURE SENSITIVE MATERIALS FOR TRANSPORTATION

[75] Inventor: Paul M. Silber, Ellicott City, Md.

[73] Assignee: In Vitro Technologies, Inc., Baltimore, Md.

[21] Appl. No.: 165,485

[22] Filed: Dec. 13, 1993

[51] Int. Cl.[6] ..... F25D 3/08

[52] U.S. Cl. ..... 62/372; 62/457.2

[58] Field of Search ..... 62/371, 372, 457.1, 62/457.2, 457.7, 60

[56] References Cited

U.S. PATENT DOCUMENTS 4,530,816 7/1985 Hamilton ..... 62/372

4,955,480 9/1980 Sexton ..... 62/372

OTHER PUBLICATIONS

FDC Packaging Will Protect Your Perishables Brochure, FDC Package, Inc. Medfield, Mass.

*Primary Examiner*—John M. Sollecito

*Attorney, Agent, or Firm*—Gay Ann Spahn

[57] ABSTRACT

An apparatus for packaging temperature sensitive materials for transportation are provided in which an insulating container is assembled from a corrugated fiberboard carton, a plastic liner bag and slab-like rigid foam insulating wall liners. The slab-like rigid foam insulating wall liners are of a size to snugly fit the inner walls of the carton and are positioned against the inner walls of the carton inside the plastic liner bag to create an insulated chamber. The insulated chamber is capable of holding two frozen bottle style refrigerant packs against its inner lined sidewall and two refrigerated brick style refrigerant packs against its top and bottom lined walls to create a cooling chamber within which temperature sensitive materials housed in a flexible foam insulation lined container are cooled by a heat transfer cooling mechanism which is capable of maintaining the temperature sensitive materials at a temperature in the range of 2° C. to 10° C. (36° F. to 50° F.) even if ambient air temperatures outside the carton reach extreme high or low temperatures for several hours.

13 Claims, 4 Drawing Sheets

APPARATUS FOR PACKAGING TEMPERATURE SENSITIVE MATERIALS FOR TRANSPORTATION

FIELD OF THE INVENTION

The present invention relates generally to an apparatus for packaging temperature sensitive materials and more particularly, to a method of and apparatus for packaging temperature sensitive materials in order to transport the temperature sensitive materials from one place to another which includes an insulated container system having positioned inside it a heat transfer cooling mechanism made up of a combination of cooling components, one that is frozen and one that is only refrigerated, in order to maintain the temperature sensitive materials at a temperature in the range of 2° C. to 10° C. (36° F. to 50° F.) even if the ambient air temperature outside the package reaches extreme high or low temperatures for several hours.

BACKGROUND OF THE INVENTION

It is well known in the prior art how to package items that are initially frozen in order to transport the items from one place to another while maintaining the item in a frozen state during transportation. It is also well known in the prior art how to package and transport items that may be maintained at any ambient temperature during transportation without damage to the item being transported.

However, there has long been a need to develop a method of and apparatus for packaging a temperature sensitive material for transportation. A temperature sensitive material is one which must be packaged in such a way so as to maintain the temperature sensitive material at a predetermined temperature. In the present invention, the temperature sensitive material is one which must be maintained in a cool state, particularly in the temperature range of approximately 2° C. to 10° C. (36° F. to 50° F.), during the transportation of the temperature sensitive material from one place to another.

It is often extremely important that a packaging system containing temperature sensitive materials keep the temperature sensitive materials in the range of temperatures of between 2° C. to 10° C. (36° F. to 50° F.) even if the outside ambient air temperatures to which the package is exposed reach somewhat extreme high or low temperatures. However, once the package leaves the control of the person who is shipping it, the package may be exposed to extremely high and low ambient air temperature.

For instance, a package shipped to northern climate in the winter months or to a southern climate in the summer months may be subjected to somewhat extreme cold or hot temperatures, respectively, for several hours. This could damage the temperature sensitive materials inside the package if the packaging system is incapable of keeping the temperature sensitive materials at an appropriate temperature despite the ambient extreme.

Another scenario, having potentially damaging effects to the temperature sensitive materials within the package, is if the package were placed in a freezer or hot room or vehicle trunk by the shipper, i.e., United Parcel Service ("UPS"), Federal Express, etc. during the transportation of the package from one location to another.

In either case, it is important that once the package carrying the temperature sensitive materials leaves the control of the person or company sending the package, the package be able to maintain the temperature sensitive materials at a temperature in the range of 2° C. to 10° C. (36° F. to 50° F.) even if the ambient temperature of the air surrounding the package reaches somewhat extreme high or low temperature for several hours.

The packaging and transportation of temperature sensitive materials has become especially important in the new and emerging fields of biotechnology. Indeed, recent biotechnological advances have been developed in which living cells can be taken from a tissue specimen in order for such cells to be transported to laboratories for experimental testing of new pharmaceuticals.

For such uses, the living cells must me kept alive which necessitates keeping the living cells cooled to a temperature of approximately 2° C. to 10° C. (36° F. to 50° F.) during transportation. At the same time, however, it is very important that the living cells be protected against freezing temperatures because freezing of the cells could cause irreversible damage thus, render them unsuitable for use in experimental testing.

Prior art devices, such as those described in U.S. Pat. No. 4,958,506 to Guilhem et al. and U.S. Pat. No. 4,530,816 to Douglas-Hamilton, disclose containers having water and ice based cooling systems which use a frozen component as the only component of the cooling mechanism.

In particular, the Guilhem et al. patent discloses an isothermic container for transporting grafts at a constant temperature equal to 4° C. (39° F.). The container of the Guilhem et al. patent includes a vessel and removable lid each of which has an outside heat insulation layer adjacent to an enclosure layer. The enclosure layer encloses a space wherein refrigerated water may be placed. The refrigerated water is maintained in a cool state by its contact with hollow studs that contain liquid butane to act as a heat exchanger.

Unlike the packaging system of the present invention, the container of the Guilhem et al. patent cannot ensure that a temperature sensitive material placed in its cooling chamber will not freeze. Furthermore, the Guilhem et al. patent's container is incapable of maintaining its contents at a range of temperatures from 2° C. to 10° C. (36° F. to 50° F.) when the ambient air temperatures reach extreme high or low temperatures.

For instance, if the packaging system of the present invention were exposed to freezing ambient air temperature such as by placing the entire packaging system containing the temperature sensitive materials in a freezer with a standard temperature of approximately −20° C. (−4° F.) for up to four (4) hours, the temperature sensitive material within the packaging system of the present invention would remain at a temperature in the range of 2° C. to 10° C. (36° F. to 50° F.). It is also true that if the entire packaging system of the present invention were placed in an approximately 38° C. (100° F.) room, vehicle trunk, etc. for up to six (6) hours, the temperature sensitive material within the packaging system of the present invention would remain at a temperature in the range of 2° C. to 10° C. (36° F. to 50° F.).

The same is not true of the container taught by the Guilhem et al. patent because the container taught by the Guilhem et al. patent does not have a cooling mechanism which includes a combination of frozen and refrigerated cooling components as does the packaging system of the present invention. Thus, the container taught by the Gullhem et al. patent could not ensure temperature sensitive materials placed inside its overall container would not freeze or become overheated if exposed to an extreme low or high ambient air temperature for several hours.

The Douglas-Hamilton patent discloses a container for cooling, preserving and safely transporting a biological specimen. The container taught by the Douglas-Hamilton patent includes a thermally insulated overall container having as its contents a container for ice, a container for specimen, i.e., a thermally insulated metal cup, and a thermally insulating sheet interposed between the specimen container and the ice.

The Douglas-Hamilton patent also discloses a method of packing biological specimen just after it is obtained. The method includes the method steps of packing the recently acquired biological specimens into a specimen container, placing a thermally insulating sheet between ice and the specimen container and placing the specimen container near the ice place within an overall insulating container. The method also includes choosing thermal constants of the container to cool down the specimens at an optimum cooling rate and to achieve an optimum steady state temperature for the specimens.

Unlike the packaging system of the present invention, the container taught by the Douglas-Hamilton patent cannot ensure that temperature sensitive materials placed inside the specimen container will be maintained at a temperature in the range of 2° C. to 10° C. (36° F. to 50° F.) if the ambient air temperature outside the package reaches extreme high or low temperatures for several hours.

It is an object of the present invention to provide a packaging system for transporting temperature sensitive materials from one place to another which is made up of a secondary insulating container which includes a corrugated fiberboard carton, a plastic liner bag, and rigid foam insulating wall liners in order to house a combination of two frozen refrigerant packs and two refrigerated refrigerant packs around a primary flexible foam-lined insulating container in which the temperature sensitive materials are placed in order to maintain the temperature sensitive materials at a temperature in the range of 2° C. to 10° C. (36° F. to 50° F.) even if the ambient air temperature outside the package reaches extreme high or low temperatures for several hours.

It is a further object of the present invention to provide a packaging system for transporting temperature sensitive materials from one place to another wherein the entire carton and its contents may be exposed to somewhat low extreme ambient air temperatures, for example, such as if placed in a standard freezer at a temperature of approximately −20° C. (−4° F.), for up to four hours without freezing of the temperature sensitive materials within the carton.

It is a further object of the present invention to provide a packaging system for transporting temperature sensitive materials from one place to another wherein the entire carton and its contents may be exposed to somewhat high extreme ambient air temperatures, for example, such as if placed in a 37.8° C. (100° F.) room, vehicle trunk, etc., for up to six hours without damage due to overheating of the temperature sensitive materials within the carton.

SUMMARY OF THE INVENTION

The present invention provides a method of and apparatus for packaging temperature sensitive materials in order to transport the temperature sensitive materials from one place to another while maintaining the temperature sensitive materials at a temperature in the range of 2° C. to 10° C. (36° F. to 50° F.) even if the ambient air temperature outside the package reaches extreme low or high temperatures for several hours. The packaging system of the present invention includes a carton lined with a plastic sheet material layer and a rigid foam insulation layer to form an insulated container in which a combination of cooling components, at least one of which is frozen and at least one of which is only refrigerated, are positioned in a predetermined manner so as to keep an insulation-lined container which houses temperature sensitive material in place against movement while maintaining the temperature sensitive material at a temperature in the range of 4° C. to 10° C. (39.2° F. to 50° F.) even if the ambient air temperature outside the package reaches extreme low or high temperatures for periods of time from approximately four to six hours, respectively.

BRIEF DESCRIPTION OF THE DRAWING FIGURES

FIG. 1(*b*) is a perspective view of the carton or cardboard box of the packaging system of the present invention shown in its partially open state with bottom, inner and outer flaps folded and top, inner and outer flaps unfolded.

FIG. 1(*c*) is a perspective view of the carton or cardboard box of the packaging system of the present invention shown in its closed, yet unsealed state.

FIG. 1(*d*) is a perspective view of the outside of the carton or cardboard box of the packaging system of the present invention shown in its taped or sealed state ready for transportation.

DETAILED DESCRIPTION OF THE INVENTION

Figure 1A:
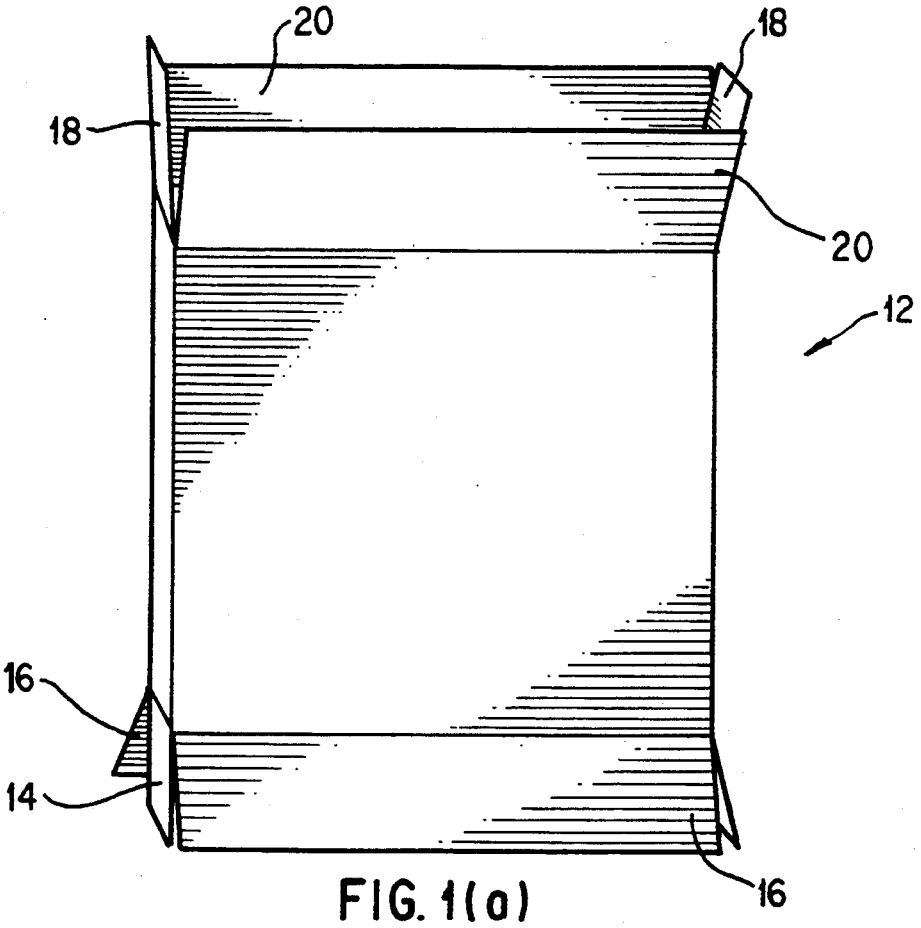
FIG. 1(*a*) is a perspective view of the carton or cardboard box of the packaging system of the present invention shown in its open state with bottom, inner and outer and top, inner and outer flaps unfolded.
Figure 1B:
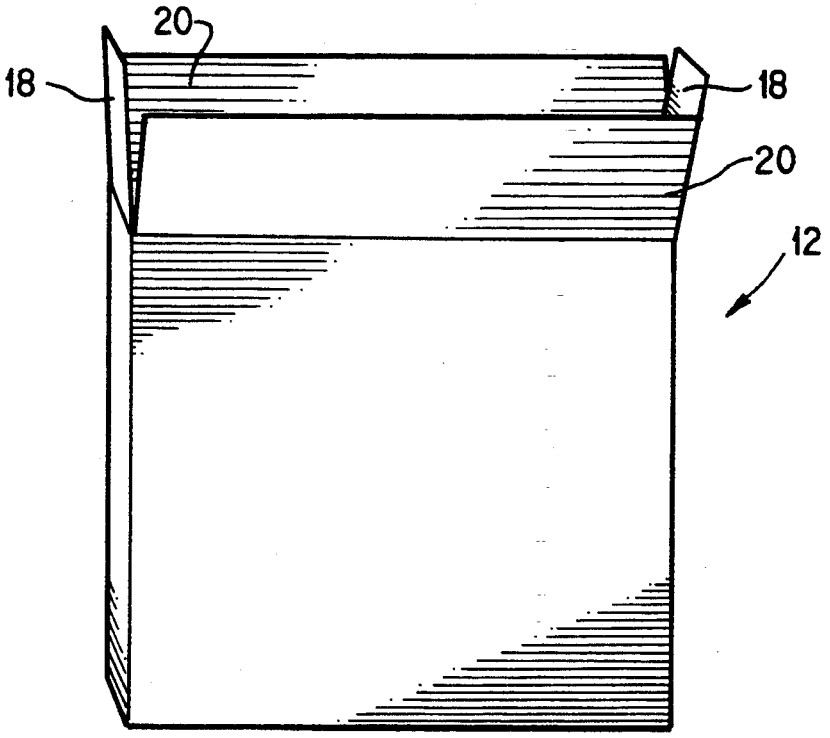
Figure 1C:
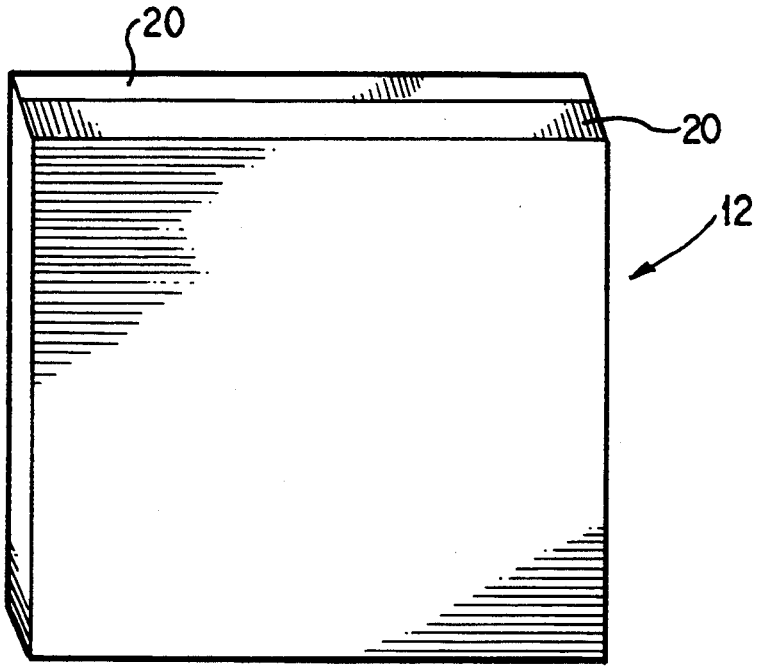
Figure 1D:
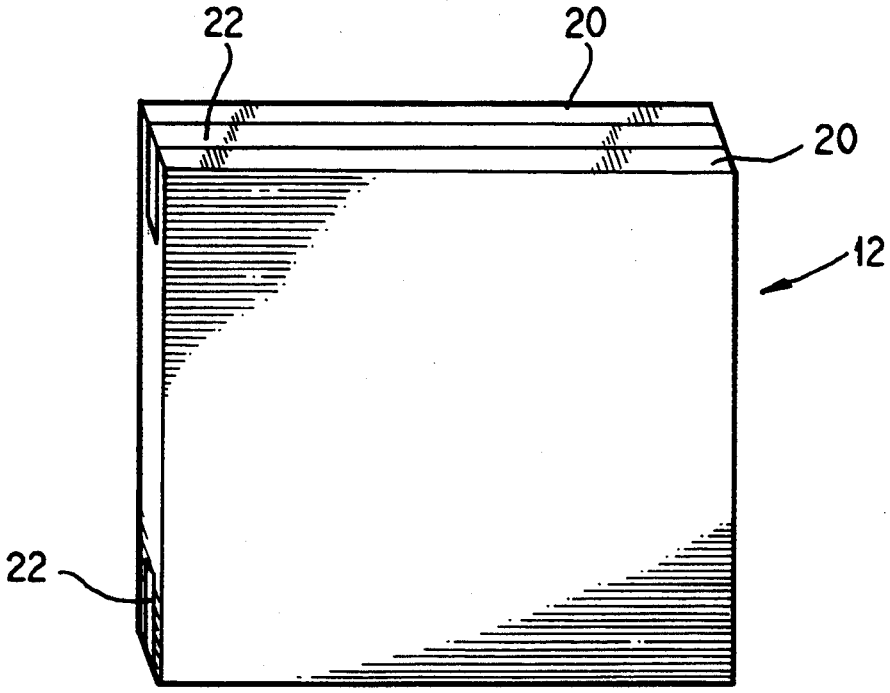

Referring to the drawing figures, there is depicted a packaging system 10 of the present invention for packaging temperature sensitive materials for transport or shipping. A component of the packaging system 10 is shown in FIGS. 1(*a*) through 1(*d*). In particular, FIGS.

1(*a*) through 1(*d*) show the carton 12 of the packaging system 10 of the present invention in various states of folding and closure.

Although the principles of the present invention will work with any size, shape or type of carton, in the preferred embodiment, the carton 12 is made of corrugated fiberboard, is cube-shaped, when folded with an approximate height of 7.5 inches high, an approximate length of 7.5 inches, and an approximate width of 7.5 inches, and is of a type having two bottom, inner flaps 14, two bottom, outer flaps 16, two top, inner flaps 18, and two top, outer flaps 20, all flaps being equal in size approximately seven inches long by 3.5 inches wide. Rectangular shaped cartons of varying dimensions and types may be used without departing from the spirit and scope of the invention.

In the preferred embodiment of the invention, the bottom, inner and outer flaps 14, 16 and the top, inner and outer flaps 18, 20 of the carton 12 are shied, i.e., non-overlapping when folded, although cartons with full length flaps may be used. A carton 12 with shied flaps, when folded, has the ends of both the inner flaps of the bottom and top 14, 18 of the carton 12 and of the outer flaps of the bottom and top 16, 18 of the carton 12 meeting at a centerline of the length or width of the carton 12. Once folded, the bottom, outer flaps 16 overlap the bottom, inner flaps 14 and the top, outer flaps 20 overlap the top, inner flaps 18 for complete closure of the carton 12.

In the preferred embodiment, the cartons 12 of the packaging system 10 of the present invention are purchased in an initially, flat folded and stacked state, however, the cartons may also be purchased in a preassembled state. Cartons 12 purchased in a folded state must be assembled, filled and sealed, by manual or automated means, for use in the packaging system 10. The sealing of both the bottoms and tops of the cartons 12, may be accomplished by any appropriate method, which in the preferred embodiment is by taping.

FIG. 1(*a*) shows a carton 12 of the packaging system 10 of the present invention in an unfolded and hollow rectangularly open state with both bottom, inner and outer flaps 14, 16 and top, inner and outer flaps 18, 20 unfolded. FIG. 1(*b*) shows the carton 12 in its unfilled state with its bottom, inner and outer flaps 14, 16 folded and unsealed, but its top, inner and outer flaps 18, 20 unfolded. FIG. 1(*c*) shows the carton 12 in its filled state with its bottom, inner and outer flaps 14, 16 and top, inner and outer flaps 18, 20 folded with the flaps ready for sealing. FIG. 1(*d*) shows the carton 12 in its filled state with its bottom, inner and outer flaps 14, 16 and top, inner and outer flaps 18, 20 folded and sealed with tape 22.

Figure 2:
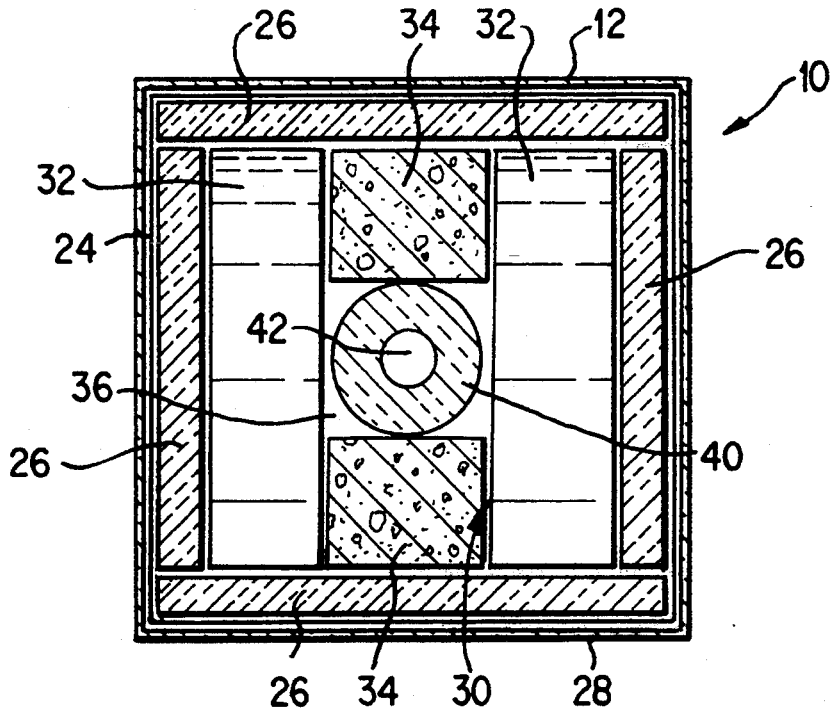
FIG. 2 is a cross-sectional view taken in the width direction through the center of the carton of FIG. 1(*d*).
Figure 3:
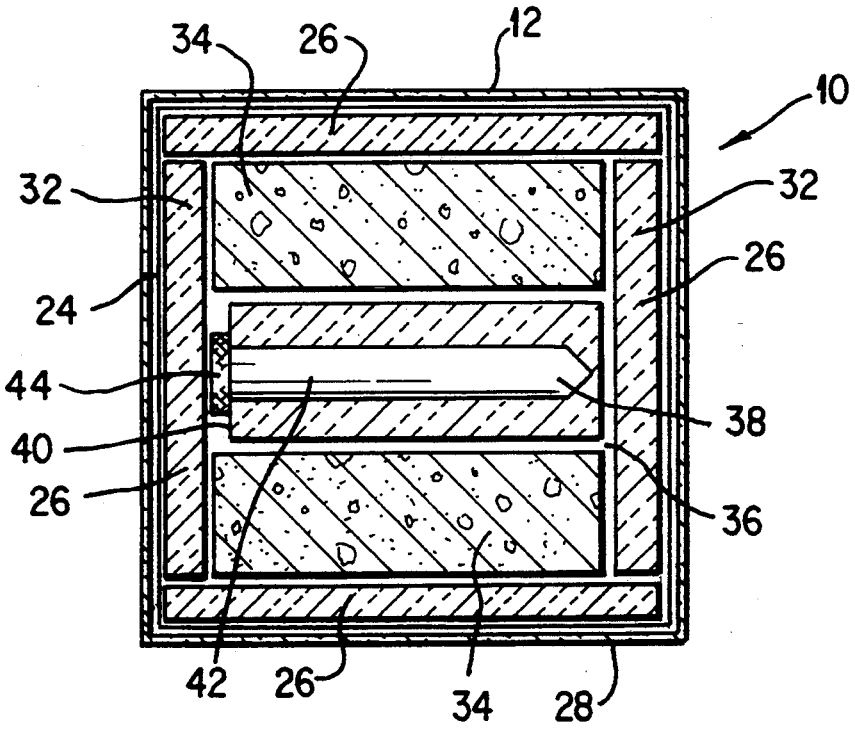
FIG. 3 is a cross-sectional view taken in the lengthwise direction through the center of the carton of FIG. 1(*d*)

FIGS. 2 and 3 show cross-sections through the height of the carton 12 of the packaging system 10 looking in both the width and the length directions, respectively. FIG. 2 shows the inside components of the carton 12 of the packaging system 10 in its width direction. FIG. 3 shows the inside components of the carton 12 of the packaging system 10 in its lengthwise direction.

Referring now to FIGS. 2 and 3, there is shown a carton 12 which is lined with a sheet material 24, preferably a plastic bag, although any sheet material 24 which acts as an insulator and can keep moisture away from the inside surface of the carton 12 may be used. The inside surface of the carton 12 has a top wall, a bottom wall and four sidewalls.

In the preferred embodiment of the present invention, the packaging system 10 includes a plastic bag 24 sold under the trademark "HEAVY DUTY TUFFMADE POLYLINER®" Bag by Rubbermaid Commercial Products Inc. of Winchester, Va. The Heavy Duty Tuffmade Polyliner® bags used in the preferred embodiment have the following characteristics. The bags 24 are made of low density polyethylene, i.e., LDPE, No. 4 plastic and are sold under product no. 5002. The plastic bags 24 have a six gallon capacity, are 43 inches in circumference, have dimensions of $11\frac{3}{4}$ inches by $9\frac{3}{4}$ inches by 22 inches high and are sized to fit Rubbermaid containers Nos.: 2103, 2504, 2614, 2830-06, 2835, 2836, 2956 and 6142. Other brand plastic bags or sheet material having similar characteristic which do not depart from the spirit and scope of the invention may be used.

The plastic bag 24 rests inside and against the four inner sidewalls and the top and bottom walls of the carton 12. In the preferred embodiment of the invention, the inner plastic lined sidewalls and top and bottom walls of the carton 12 are then lined with slab-like layers or wall liners 26 cut from sheets of rigid foam insulation material. The preferred rigid foam insulation material for use in the packaging system 10 of the present invention is a thermally efficient, expanded polystyrene ("EPS") insulation, however, any type of insulating material capable of carrying out the principles of the invention may be used.

In the preferred embodiment of the invention, one inch thick sheets of the polystyrene are precision cut to snugly fit the inner walls of the carton 12 and thus, ensure superior temperature retention. The sheets of polystyrene are preferably cut into two seven inch by seven inch square slabs to fit against the top and bottom walls of the carton 12 and four five inch by six inch slabs to fit in overlapping fashion against the sidewalls of the carton 12. However, any combination of wall sizes that is capable of lining the inner walls of the particular size carton 12 used to carry out the principles of the invention may be used.

The carton 12, plastic liner bag 24, and slab-like wall liners 26, once assembled, form a secondary insulating container 28. The materials forming the secondary insulating container 28 may be purchased separately or in kit-form from one of several manufacturers such as FDC Packaging, Inc. of Medfield, Mass. which sells a kit under the trademark "FDC®" Shipping Containers. In the preferred embodiment, the secondary insulating container 28 used is FDC®'s kit no. SL1-K, having inside dimensions of five inches by five inches by five inches and a volume of 0.072 cubic feet.

Within the five inch by five inch by five inch chamber of the secondary insulating container 28, other components of the packaging system 10 are positioned as shown in FIGS. 2 and 3. In particular, a heat transfer cooling mechanism 30 is formed by using a combination of frozen and refrigerated cooling units or packs.

Figure 4:
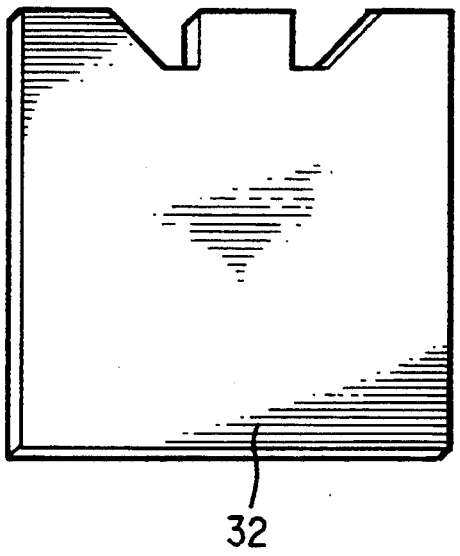
FIG. 4 is a perspective view of the frozen component of the packaging system of the present invention.
Figure 5:
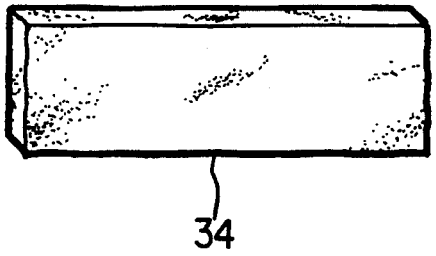
FIG. 5 is a perspective view of the refrigerated component of the packaging system of the present invention.

In the preferred embodiment of the invention, the cooling mechanism 30 is made up of a combination of four cooling units including two bottle style refrigerant packs 32 and two brick style refrigerant packs 34 as shown in FIGS. 4 and 5, respectively. The refrigerant packs 32, 34 of the preferred embodiment are sold under the trademark "KOOLIT®" by FDC Packaging, Inc. of Medfield, Mass., although any brand of refrigerant packs having the same properties and cooling characteristics so as not to depart from the spirit and scope of the invention may be used.

Referring to FIG. 4, in the preferred embodiment of the invention, the bottle style refrigerant pack 32 is sold under FDC product no. 408 and has dimensions of 4.5 inches by 4.25 inches by 1.5 inches to fit snugly against one of the inner sidewalls of the secondary insulating container 28. This bottle style refrigerant pack 32 has an average weight of 0.75 pounds (12 ounces, 340 grams) and an average heat capacity of 146 BTU from −23° C. to 10° C. (−10° F. to 50° F.). The two bottle style refrigerant packs 32 used in the present invention contains a non-water based, non-toxic chemical to produce a uniform temperature over an extended period of time. In the preferred embodiment, both bottle style refrigerant packs 32 are frozen to a temperature of approximately −20° C. (−4° F.) for placement in the packaging system 10 against opposing inner sidewalls of the secondary insulating container 28. The freezing of the bottle style refrigerant packs 32 does not create significant problems due to expansion because the bottle style refrigerant packs 32 are non-water based.

Referring to FIG. 5, in the preferred embodiment of the invention, the brick style refrigerant packs 34 are sold under FDC product no. 308 and have dimensions of 4.5 inches by 2 inches by 1.5 inches to fit snugly against the inner top and bottom walls of the secondary insulating container 28 between the bottle style refrigerant packs 32 as is depicted in FIG. 3. These brick style refrigerant packs 34 have an average weight of 0.45 pounds (7.22 ounces, 205 grams) and an average heat capacity of 85 BTU from −23° C. to 10° C. (−10° F. to 50° F.). The two brick style refrigerant packs 34 used are made up of a block of rigid open-celled foam which is impregnated with a non-toxic, aqueous solution and then loosely sealed in a heavy duty polyethylene pouch. In the preferred embodiment of the invention, both brick style refrigerant packs 34 are only refrigerated to a temperature of approximately 4° C. (39.2° F.) and not frozen solid as is suggested by the directions on the label for use in a conventional shipping container.

Two bottle style refrigerant packs 32 are positioned against opposing inner sidewalls of the secondary insulating container 28 and two brick style refrigerant packs are positioned against the inner top and bottom wall of the secondary insulating container 28 as shown in FIG. 2. The refrigerant packs 32, 34 positioned in this manner create an approximately five inch by five inch by two inch cooling chamber 36. A chamber of this size is capable of housing a sealed or capped primary insulating container 38 around which an insulating liner or tube 40 has been placed.

Figure 6:
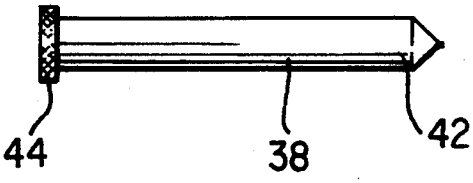
FIG. 6 is a front view of the temperature sensitive material container of the packaging system of the present invention.
Figure 7:
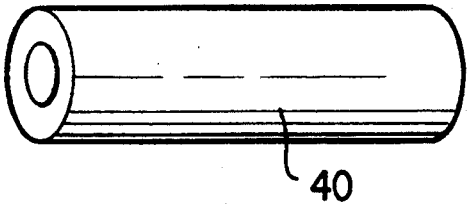
FIG. 7 is perspective view of the flexible foam insulation tube which slidingly fits over the temperature sensitive material container of FIG. 6 of the packaging system of the present invention.

In the preferred embodiment of the present invention, the primary insulating container 38 is an approximately 15 ml plastic test tube or centrifuge tube as shown in FIG. 6. The insulating liner or tube 40 is a hollow, flexible foam cylindrically-shaped member, as shown in FIG. 7, which slidingly accepts the test tube within its approximately ¾th inch in diameter central bore. The 15 ml tube 38 is approximately 4 11/16 inch long and 11/16th of an inch in diameter with a tapered bottom. The flexible foam insulating liner or tube 40 is approximately four inches long by 1.5 inches in outer diameter with a wall thickness of approximately ⅜th of an inch.

The primary insulating container 38 of the preferred embodiment is used to house temperature sensitive materials 42 such as living cells from tissue samples or specimens, although other perishable items may benefit from the teachings of the present invention. It should be noted that the 15 ml test tube of the preferred embodiment does not limit the invention as the principles may be applied to any size primary insulating container 38 and its correspondingly appropriate sized secondary insulating container 28.

Experimentation has shown that the combination of two frozen, bottle style refrigerant packs 32 and two refrigerated, brick style refrigerant packs 34 positioned within the secondary insulating container 28 and surrounding a flexible foam insulating liner or tube 40 around primary insulating container 38 housing temperature sensitive materials 42 will maintain the temperature sensitive materials 42 at a temperature within the range of 2° C. to 10° C. (36° F. to 50° F.). Indeed, the packaging system 10 of the present invention has been shipped from the United States to Europe with the temperature sensitive materials arriving intact.

Furthermore, the temperature sensitive materials 42 will be maintained at a temperature in the range of 2° C. to 10° C. (36° F. to 50° F.) even if the ambient air temperature outside the package reaches somewhat extreme high temperature of approximately 38° C. (100° F.) or a somewhat extreme low temperature of approximately −20° C. (−4° F.) for a period of six or four hours, respectively.

In operation, the packaging system 10 of the present invention works as follows. The temperature sensitive materials 42, such as living cells or tissue samples, are obtained from the specimens and placed in the primary insulating container 38. The temperature sensitive materials 42 may be placed in the primary insulating container 38 with or without a supportive liquid media or preservation media. The primary insulating container 38 is sealed or capped with a friction fit or screw-on type covering 44. The primary insulating container 38 is then slid through the central bore of a flexible foam insulating liner or tube 40 to insulate the temperature sensitive materials 42 from the refrigerant packs which it will be placed adjacent to and to protect the primary insulating container 38 against movement within the secondary insulating container 28. The temperature sensitive materials 42 may be stored in a refrigerator at approximately 4° C. (39° F.) until such time as the packaging system is assembled and ready for transport.

Just prior to transport, the primary insulating container 38 may be filled with recently obtained temperature sensitive materials 42 or may be removed from refrigeration where it has been awaiting transport and the secondary insulating container 28 is readied. The secondary insulating container 28 is either preassembled or quickly assembled just prior to shipping of the temperature sensitive materials 42. The secondary insulating container 28 is assembled as follows. A folded carton 12 is removed from its stack, opened into its unfolded state, and partially closed by folding the bottom inner flaps 14, folding the bottom outer flaps 16 and then sealing the carton 12 bottom by attaching a strip of tape 22 on the outer bottom walls and sidewalls of the carton 12.

The assembly of the secondary insulating container 28 proceeds by opening the plastic bag 24 and placing it inside the carton 12 to rest against and line the inner walls of the carton 12. The slab-like insulating wall liners 26 of rigid foam insulation material which have been cut to fit the inner walls of the carton 12 are then positioned within the plastic bag 24 lined carton 12 with the bottom slab-like insulating wall liner 26 being positioned first and the side slab-like insulating liner walls 26 being placed next in overlapping or interlocking fashion. The top slab-like insulating wall liner 26 is reserved for later positioning within the carton 12 until the other contents of the packaging system have been positioned inside the carton 12.

Two bottle style refrigerant packs 32 which have been frozen solid to approximately −20° C. (−4° F.) are placed within the insulation lined walls of the carton 12 against opposing sidewalls in an upright position. Next a brick style refrigerant pack 34 which has only been refrigerated to approximately 4° C. (39° F.) is placed inside the carton 12 against the bottom insulation lined wall and between the two bottle style refrigerant packs. The flexible foam lined primary insulating container 38 is then placed inside the carton 12 on top of the refrigerated brick style refrigerant pack 34 and between the frozen bottle style refrigerant packs 32. A second refrigerated brick style refrigerant pack 34 is placed inside of the carton 12 on top of the flexible foam lined primary insulating container 38.

The secondary insulating container 28 is completed by placing the top slab-like rigid foam insulation liner wall 26 against the tops of the inner sidewall liners, the two frozen bottle style refrigerant packs 32 and the second, uppermost-positioned refrigerated brick style refrigerant pack 34. The plastic bag 24 is then gathered and closed around the top slab-like rigid foam insulation liner wall 26, the top inner flaps 18 are folded, the top outer flaps 20 are folded and the top outer flaps 20 of the carton 12 are sealed by a strip of tape 22 on the outside surfaces of the outer flaps and the outer sidewalls of the carton 12. The filled and sealed carton 12 is now ready for transport and shipping.

The present invention has been shown in the drawing figures and described in detail in its preferred embodiment for the purposes of illustration, however, variations and departures can be made therefrom by one of ordinary skill in the art without departing from the spirit and scope of the invention.

I claim:

1. A packaging system for packaging temperature sensitive materials for transport comprising:

an outer insulating container comprising:

a carton having a top inner wall, a bottom inner wall and inner sidewalls; and means for insulating said cavity comprised of a lining disposed adjacent said inner walls of said carton to define an insulated cavity;

cooling means for placement within said insulated cavity to cool said insulated cavity comprising:

a plurality of refrigerant pack means for positioning within said insulated cavity adjacent to said means for lining said inner walls wherein said refrigerant pack means include a combination of frozen refrigerant packs and refrigerated refrigerant packs; and an inner insulating container comprising:

container means for housing said temperature sensitive materials; and insulation means for placement around said container means to insulate said container means from said refrigerant packs surrounding said container means thereby defining an insulation lined container means when said insulation lined container means is placed in position in said cavity of said carton and adjacent said refrigerant packs.

2. The packaging system as in claim 1 wherein said temperature sensitive materials is matter which must be kept at a temperature between 2° C. and 10° C. (36° F. to 50° F.).

3. The packaging system as in claim 2 wherein said matter is comprised of living cells or tissue obtained from specimens for use in experimental testing of pharmaceuticals.

4. The packaging system of claim 2 wherein said means for insulating said cavity comprises inner liner means for placement directly against said inner walls to retain moisture away from said inner walls of said carton and to retain temperature within said cavity.

5. The packaging system of claim 4 wherein said inner liner means is a plastic bag.

6. The packaging system of claim 5 wherein said means for insulating said cavity further comprises outer liner means for placement adjacent to said inner liner means to snugly fit against said inner walls of said carton for retaining temperature within said cavity.

7. The packaging system of claim 6 wherein said outer liner means are slab-like pieces of rigid foam insulation cut from sheets to snugly fit said inner walls of said carton.

8. The packaging system of claim 7 wherein said rigid foam insulation is expanded polystyrene insulation or EPS.

9. The packaging system of claim 8 wherein said frozen refrigerant packs are bottle shaped refrigerant packs which contain a non-toxic chemical to produce a uniform temperature over a long period of time.

10. The packaging system of claim 9 wherein said refrigerated refrigerant packs are brick shaped refrigerant packs which contain a block of rigid open-celled foam impregnated with a non-toxic aqueous solution sealed within a heavy-duty polyethylene pouch.

11. The packaging system as in claim 10 wherein said carton is made of corrugated fiberboard.

12. The packaging system as in claim 11 wherein said container means is a test tube or centrifuge tube with cap to close or seal said tube.

13. The packaging system as in claim 12 wherein said insulating means for insulating said container means is a flexible foam cylindrical liner or tube.

* * * * *